United States Patent [19]

Johnson et al.

[11] Patent Number: 5,041,823

[45] Date of Patent: Aug. 20, 1991

[54] FLICKER-FREE LIQUID CRYSTAL DISPLAY DRIVER SYSTEM

[75] Inventors: Michael J. Johnson, Phoenix, Ariz.; Ronald C. Robinder, Albuquerque, N. Mex.

[73] Assignee: Honeywell Inc., Minneapolis, Minn.

[21] Appl. No.: 291,726

[22] Filed: Dec. 29, 1988

[51] Int. Cl.[5] ..... G09G 3/36

[52] U.S. Cl. ..... 340/784; 340/793; 340/811

[58] Field of Search ..... 340/765, 784, 793, 805, 340/811; 358/230, 236; 350/333

[56] References Cited

U.S. PATENT DOCUMENTS

| | | | |
|---|---|---|---|
| 4,455,576 | 6/1984 | Hoshi | 358/236 |
| 4,635,127 | 1/1987 | Togashi | 358/236 |
| 4,825,203 | 4/1989 | Takeda et al. | 340/784 |

FOREIGN PATENT DOCUMENTS

| | | |
|---|---|---|
| 0149899 | 7/1985 | European Pat. Off. . |
| 0197551 | 10/1986 | European Pat. Off. . |
| 0241562 | 10/1987 | European Pat. Off. . |
| 137587 | 10/1980 | Japan . |
| 137588 | 10/1980 | Japan . |
| 153388 | 9/1984 | Japan . |
| 159178 | 9/1984 | Japan . |
| 253562 | 9/1984 | Japan . |
| 127387 | 7/1985 | Japan . |
| 200918 | 7/1985 | Japan . |
| 156095 | 8/1985 | Japan . |
| 258590 | 12/1985 | Japan . |
| 198279 | 2/1986 | Japan . |
| 294416 | 12/1986 | Japan . |
| 017731 | 1/1987 | Japan . |
| 071932 | 4/1987 | Japan . |
| 113129 | 5/1987 | Japan . |
| 116924 | 5/1987 | Japan . |
| 175074 | 7/1987 | Japan . |
| 195628 | 8/1987 | Japan . |
| 209515 | 9/1987 | Japan . |
| 209584 | 9/1987 | Japan . |
| 324147 | 10/1987 | Japan . |
| 337657 | 10/1987 | Japan . |

OTHER PUBLICATIONS

"A New Driving Technique for Flicker-Free Full Resolution LC-TV" by T. Katagishi et al., *SID* 86 *Digest*, Article 16.3, pp. 285-288.

"Full Liquid Crystal Television Addressed by Amorphous Silicon TFTS", by M. Yamano et al., *Journal of Non-Crystalline Solids* (77 & 78) 1985, pp. 1383-1388.

"5-Inch Size Full Color Liquid Crystal Television", by M. Yamano et al., *IEEE Transactions on Consumer Electronics*, vol. CE-31, No. 1, Feb., pp. 39-46.

"4.25-Inch and 1.51-Inch B/W and Full-Color LC Video Displays", by S. Morozumi et al., SID 84 Digest, Article 18.4, pp. 316-319.

"Imaging System Design Based on Psychophysical Data", by W. E. Glenn et al., *SID* 84 *Digest*, Article 17.5, pp. 294-297.

IBM Technical Disclosure Bulletin, "New Driving Method for Liquid Crystal Display", vol. 30, No. 12, May 1988.

"Display Driver ICs Light the Way for Flat-Panel Displays" by Gene Heftman, Mar. 13, 1986, pp. 29-34, Eelctronic Design.

*Primary Examiner*—Jeffery A. Brier

*Attorney, Agent, or Firm*—John G. Shudy, Jr.

[57] ABSTRACT

A flicker-free liquid crystal display driver system driving two groups of pixels with alternating polarities. The spatial differentiation of the two groups, which may be accomplished in terms of even and odd rows or columns, is small so as to diminish detection by a human eye of the flicker in the display. The driver system incorporates a level shifter, switches, drivers, a driver switch control, a holding means and a storage means. Input signals to the system include that of intensity data, a clock and frames. The configuration of the driver system may be of a single-edge or redundant drive. The system may be digital or analog.

7 Claims, 9 Drawing Sheets

VIEW ANGLE: +45°
DC VOLTS: 7V
AC VOLTS: 2V

VIEW ANGLE: −45°
DC VOLTS: 7V
AC VOLTS: 2V

FLICKER-FREE LIQUID CRYSTAL DISPLAY DRIVER SYSTEM

BACKGROUND OF THE INVENTION

The present invention pertains to displays and, particularly, to liquid crystal displays (LCD's). More particularly, the invention pertains to active matrix LCD's.

LCD technology is being developed as a possible successor to cathode ray tube (CRT) technology for many applications. LCD technology offers important advantages, such as higher reliability and reduced power, size and weight. However, in the current state of development, LCD image rendering capability falls short of that achievable using CRT's. The present invention addresses one of the major technical obstacles which is the unacceptable flicker of flat panel LCD's.

The flicker problem originates in the manner that LCD's are driven. Flat panel LCD's need to be refreshed periodically with alternating voltage. The polarity of the voltage is typically switched after each vertical sync in order to prevent electroplating action from occurring. Electroplating action can damage electrodes inside the flat panel. Odd frames 11 of the image are driven by a minus voltage (−V), for example, while even frames 12 are driven by a positive voltage (+V) (in FIGS. 1*a* and 1*b*). Since the electro-optical response of the LC material depends solely on the magnitude of the voltage (V), polarity changes after each frame should have no optical effect. However, polarity changes do have a noticeable effect.

FIGS. 1*a* and 1*b* reveal the prior art off-axis output of an LCD. FIG. 1*a* is a graph showing the idealized average level of optical output per frame, 11 or 12, relative to the voltage polarities of the driving signals, as distributed temporally. FIG. 1*b* shows how the polarity dependent regions are distributed spatially over a display surface. The regions are switched to the opposite polarity at the end of each frame. Each of the regions cover the entire image display. The optical output has a frequency component that is one-half of the frame frequency.

Active matrix LCD technology is preferred in cockpit applications, because it has great potential for realizing the required level of performance under adverse conditions. Active matrix displays typically use semiconductor devices as switches (most often thin film transistors) to transfer appropriate voltages to each LC picture element (i.e., pixel). Although these switching devices are designed to behave independently of polarity, they exhibit asymmetric properties. They appear to charge faster or conduct better for one polarity than for the other. Consequently, active matrix LC Displays, using such polarity-dependent devices to energize the LC material, manifest polarity-dependent optical behavior (FIGS. 2*a* and 2*b*). This polarity-dependent optical behavior is perceived as flicker by the eye. FIGS. 2*a* and 2*b* are graphs that reveal the output of an LCD having switched polarities, at a plus 45 degree viewing angle and a minus 45 degree viewing angle, respectively.

Part of the flicker effect can be tuned out for a given viewing angle by adjusting the magnitudes of the applied voltages. Some display designers in the industry have found this to be an adequate solution. The voltages are adjusted to compensate for the polarity dependence. For example, the magnitude of +V may be made slightly higher than that of −V to account for biases in the active matrix LCD. However, because of the complex characteristics of LCD's, such tuning fails when the panel is viewed from other angles. So, for applications requiring wide viewing angles this solution is inadequate.

In general, if the panel is refreshed at frequency (F), then the polarity must be alternated at every half period or at frequency F/2. Because of the asymmetries mentioned above, polarity alternation causes the optical output of the LC display to have an undesirable side effect; the image gets modulated at F/2. An image refreshed at 60 hertz (Hz) will cause a 30 Hz frequency component to appear over the entire surface of the screen. 30 Hz results in very perceptible and objectionable flicker. On this basis, those skilled in the art conclude the refresh frequency must be raised to the point where F/2 is high enough to avoid flicker. In the inventors' laboratory, the refresh frequency had to be raised to 90 Hz. However, high refresh frequencies have severe penalties associated with them. Such frequencies raise the complexity, speed and cost of the entire display system. Transistors in the LCD must be designed to operate faster. The graphics processors, image memories and interface circuitry in the symbol generator and the display head require higher performance components and must use more costly architectures which are items to be avoided whenever possible.

SUMMARY OF THE INVENTION

The invention circumvents LCD flicker difficulties without incurring the more costly architectures needed for the high refresh frequencies, by taking advantage of spatial and temporal frequency characteristics in the human visual system. The eye has been modeled as having two separate channels for acquiring spatial information. One channel, which has fast neurons, responds to rapid luminance changes as long as the changes occur over broad feature sizes (low spatial frequency). The channel has high bandwidth in the temporal frequency domain but low bandwidth in the spatial frequency domain. The other channel, using slow neurons but sensitive to small feature sizes, behaves in an opposite manner. It can resolve fine image detail but responds slowly to what it discriminates. It has high bandwidth in the spatial frequency dimension but low bandwidth in the temporal frequency dimension.

The above-described model of the eye implies that changing polarity globally over the entire surface of the display, as has been done, is incorrect. Polarity changes over a broad region are detected by the fast channel of the eye where the changes are easily noticed. However, polarity changes made locally, in small regions, are less likely to be detected, wherein the eye is not able to detect the optical effects of the rapid polarity changes. Placing the shifts in the domain of high spatial frequencies puts the flicker problem in the slow detection channel of the eye. Interwoven rows, columns or any patterns of small feature size are used in the invention to keep the spatial frequency of the polarity pattern high enough. In this way, flicker is eliminated.

The preferred embodiment of the invention includes a column driver integrated circuit (IC) which permits columns to be conveniently and efficiently interwoven. It uses a segment of drivers for the even columns and another segment for the odd columns. Each segment can be connected to voltage supply rails of opposite polarity. The even segment can be connected to one polarity, while the odd segment can be connected to the other polarity. This done, the odd and even outputs can be interwoven out of the IC, providing convenient routing to the panel.

Alternatively, a selection signal on the IC can place the driver into a traditional drive configuration. The driver can be directed to connect the odd segment and the even segment together to select the same supply rails. Further, this driver can be implemented to provide either analog or digital output control.

Moreover, both anti-flicker drivers need to be attached to only on edge of the flat panel display to eliminate flicker, as opposed to the current art which requires attachment to opposite edges of the flat panel displays. This results in mechanical benefits, including smaller size, simpler layout and easier implementation. These features are amenable to long-term objectives for installing the drivers within the flat panel display itself.

Another embodiment of the invention has a column driver tailored to include anti-flicker capability. By making its polarity switch operate faster, it is optimized for delivering row interweave capability. The input normally driven by the frame signal, which alternates after every vertical retrace, is instead driven by a signal which alternates after every row.

The present invention is usable with a wide range of formats. In view of the fact that many products use an extensive variety of scanning formats and because flicker is so dependent on timing, such general applicability of the present invention is extremely desirable. Further, because of the tight volume constraints targeted for most flat panel applications, obtaining mechanical efficiency while eliminating flicker through the present invention is also significant. In summary, today's flat panel drivers do not provide anti-flicker functionality like that of the present invention.

DESCRIPTION OF THE PREFERRED EMBODIMENTS

Figure 3A:
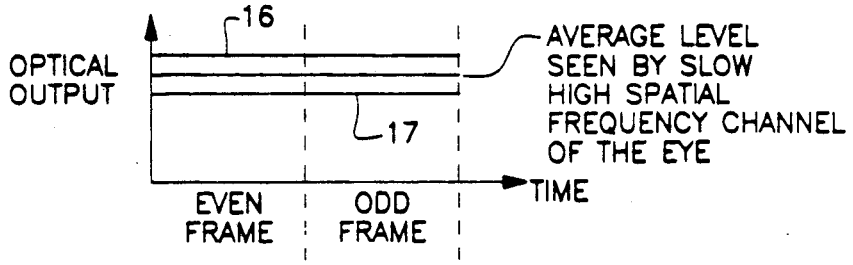
FIGS. 3*a* and 3*b* show the optical output seen by the eye and the optical output over the display surface, respectively, for a row implementation.
Figure 3B:
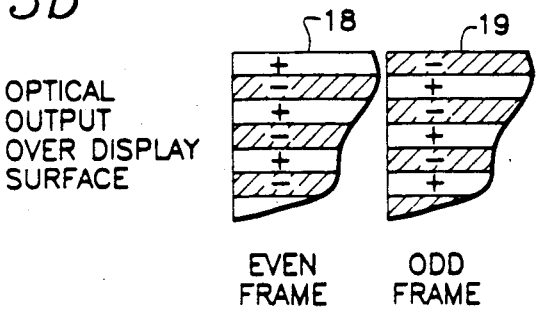

In the applicants' laboratory, the operational characteristics of the invention were simulated using interwoven rows (as illustrated in FIGS. 3*a* and 3*b*). Positive and negative voltages were applied to the columns of a Hosiden panel as a function of even/odd rows and frames. Even rows were driven with one polarity applied while odd rows were driven with the other. When the frame was done, polarities were reversed. Frame refresh was performed at frequencies as low as 45 Hz. Flicker was absent at all viewing angles, proving the basic operability of the invention. It was evident from this experiment that high refresh frequencies, such as 90 Hz, were not needed any longer to eliminate the flicker.

Figure 1A:
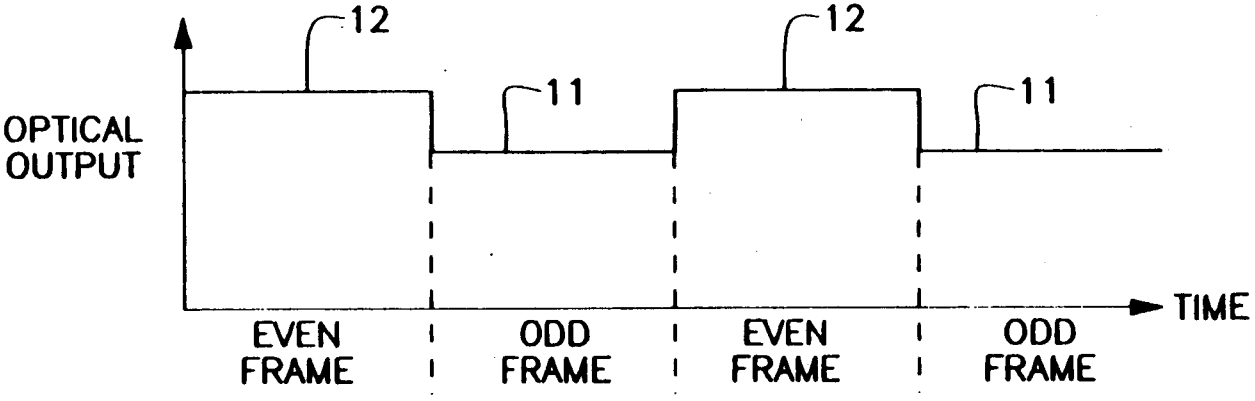
FIGS. 1*a* and 1*b* show off-axis LCD optical outputs for even and odd frames and the optical outputs over a display surface, respectively, of prior art.
Figure 1B:
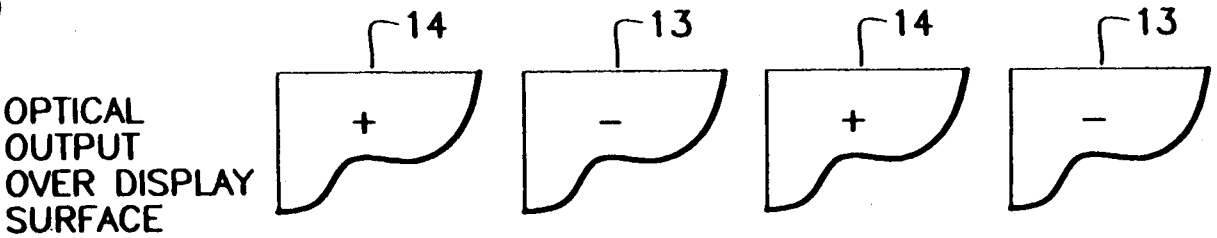
Figure 2A:
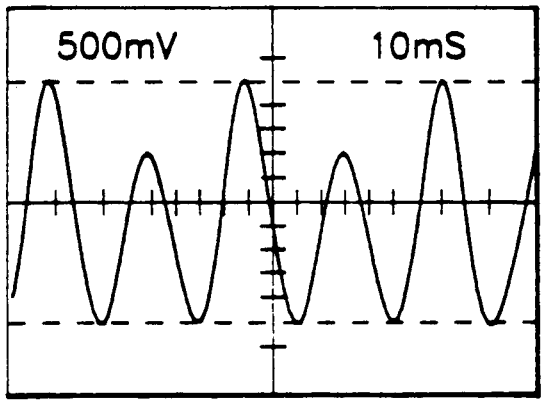
FIGS. 2*a* and 2*b* are graphs that reveal the output of an LCD having switched polarities, at a plus 45 degree viewing angle and a minus 45 degree viewing angle, respectively.
Figure 2B:
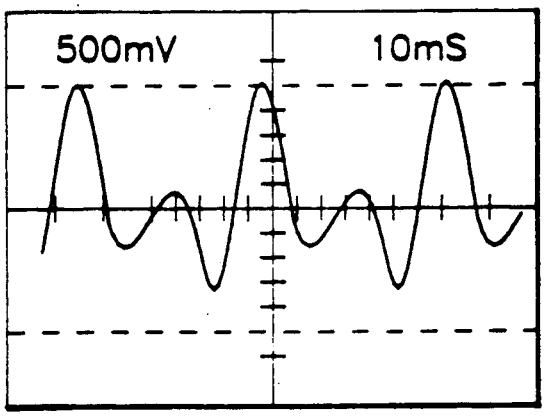

FIGS. 3*a* and 3*b* show, in contrast to FIG. 1*a*, the difference in off-axis optical outputs of the LCD in the prior art and the invention, respectively. The optical output versus time shows the different level outputs 16 and 17 to be happening at the same time at a much higher spatial frequency in FIG. 3*a*, in contrast to the low frequency outputs 11 and 12 in FIGS. 1*a* and 1*b*. The higher spatial frequency of the interwoven rows allows the eye to see only the average of the two levels, 16 and 17, present. FIG. 3*b* spatially shows optical outputs 18 and 19 on the display having parts of the screen at different voltage levels or polarities for the same frame. FIG. 3*b* shows the polarities of the rows switching from even frame 18 to odd frame 19, after each frame scan is completed.

There are several ways possible of implementing the idea of interweaving the optical/polarity changes at higher spatial frequencies. One approach, discussed above, is to provide interwoven polarity changes on every other row or pair of rows, or trio of rows, etc. The number of adjacent rows being driven by a common polarity needs to satisfy only two criteria: 1) the number of rows, side by side, driven by one polarity must occupy a small field of vision, under approximately 4 arc-seconds of viewing angle in order to be effective; and 2) the number of rows, side by side, driven by one polarity, must be in proper ratio with the number of lines in a frame (or field) in order to avoid standing waves of static non-shifting polarity patterns. This is needed to prevent DC voltage from being applied to the panel.

In order for the present invention to operate, the column drivers need to be modified to switch from one polarity to the other more quickly. Typically, switching happens during a vertical retrace, when several hundred microseconds are available for the transition. To switch at the end of a row, however, the column drivers need to be able to change polarity in a manner that will not waste valuable scan time. Each row lasts on the order of only a few tens of microseconds, typically from 16 to 63 microseconds. Therefore, in order to minimize adverse effects, the column drivers need to be able to change polarity in less than a few microseconds, ideally in less than one microsecond. An improved column driver, one which provides functionality for eliminating flicker, is one which uses standard technology to deliver a faster polarity switch.

In the inventors' laboratory, the slow switching speed of the column drivers was compensated by extending the row time and by reducing the number of rows in the image. These two things, together, were done to maintain a given image refresh rate. As was stated earlier, interweaving the rows in this manner eliminated flicker altogether and made the viewer feel as if he were observing a stable image displayed on a sheet of paper instead of on a periodically refreshed electronic display device.

Figure 4A:
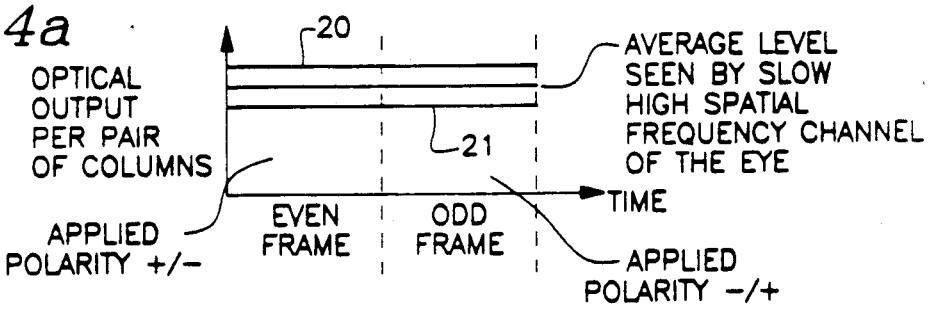
FIGS. 4*a* and 4*b* show the off-axis optical outputs for a column implementation.
Figure 4B:
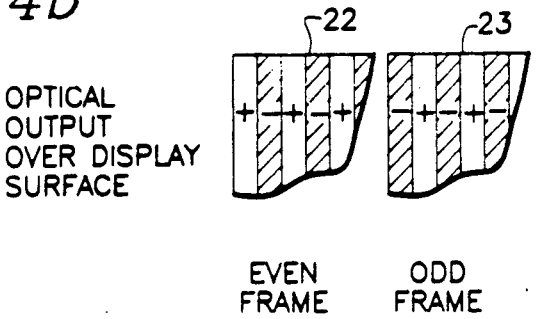

Another approach, as shown in FIGS. 4*a* and 4*b*, is to interweave polarity changes using columns. FIG. 4*a* and 4*b* illustrate the off-axis optical outputs 20–23, temporally and spatially, for a column implementation of the invention. FIG. 4*a* shows the optical outputs 20 and 21 per pair of columns for the even and odd frames. The eye tends to integrate the plus and minus regions within outputs 20 and 21 into a constant level output. FIG. 4*b* illustrates the column optical outputs 22 and 23 over the display surface for even and odd frames, respectively, wherein the polarities are switched after each frame. The regions of opposite polarities are averaged into a DC level.

Figure 5:
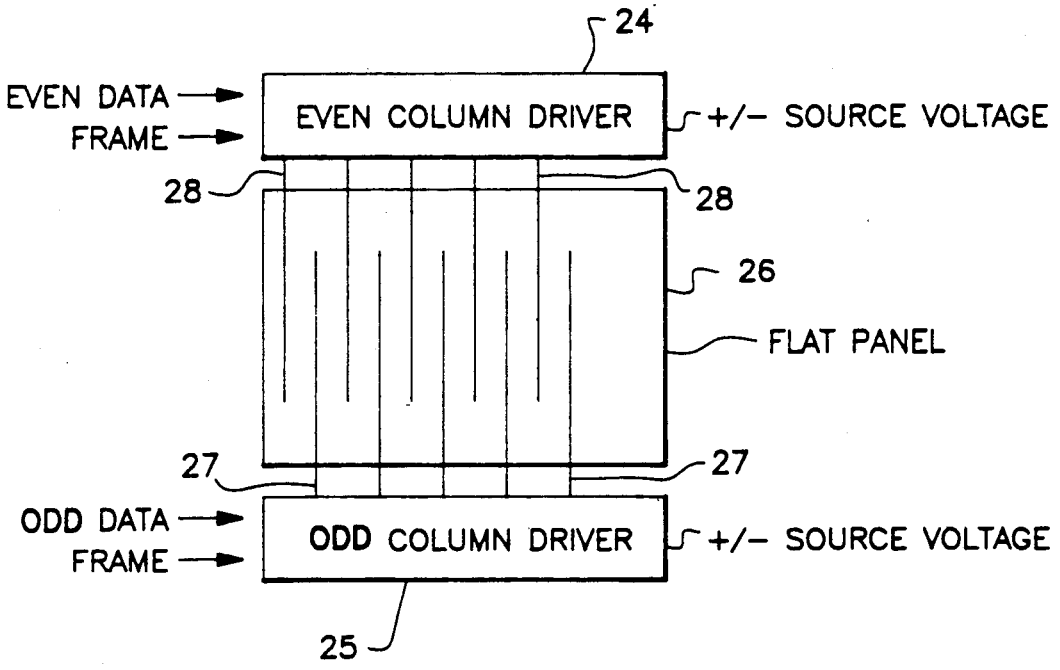
FIG. 5 shows an even and odd column driver configuration for a flat panel.

This can be done by placing standard column drivers 24 and 25 at the top and at the bottom of display panel 26 (as shown in FIG. 5). The polarity changes are interwoven among the columns by the standard drivers 24 and 25. Drivers 24 and 25 refresh the image with an alternating voltage. At any given time, even columns 28 use one polarity while odd columns 27 use the other polarity. Each polarity changes to the other after each frame (or vertical sync signal). The top set of column drivers 24 can be used to drive even columns 28 and the bottom set of drivers 25 can be used to drive odd columns 27. To achieve the interwoven polarity changes, the top set of drivers 24 can be used to apply voltages of one polarity while the bottom set of drivers 25 can be used to apply the other. After each frame is completed, signified by the occurrence of a vertical sync pulse, the polarities are reversed on the top and bottom drivers, 24 and 25, respectively. This method was also tested in the laboratory. As might be expected, given the model for the human visual system, interwoven columns succeeded in eliminating flicker just as effectively as the row method did.

Figure 6:
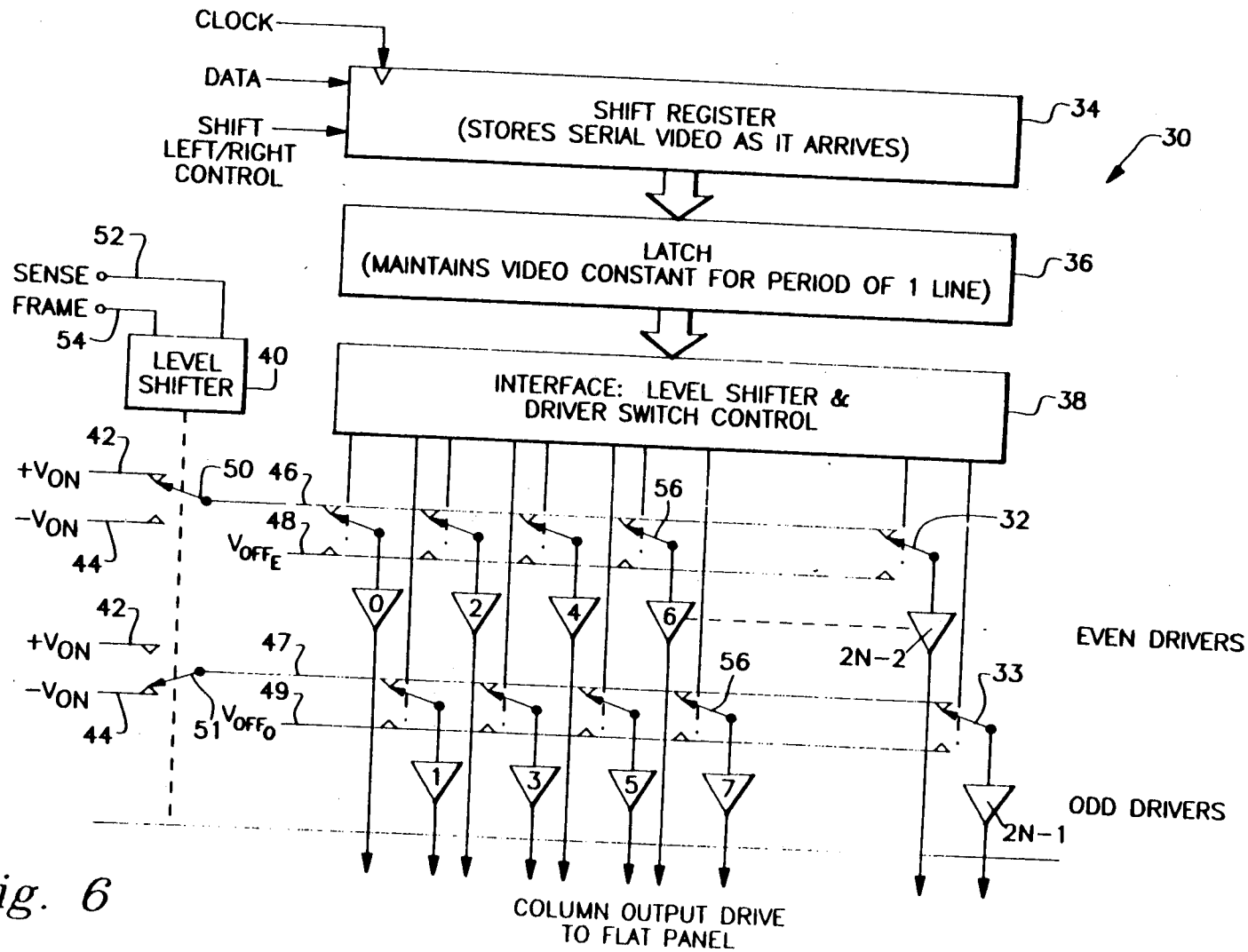
FIG. 6 is a block diagram and schematic of an even-odd column driver and associated circuitry.
Figure 7:
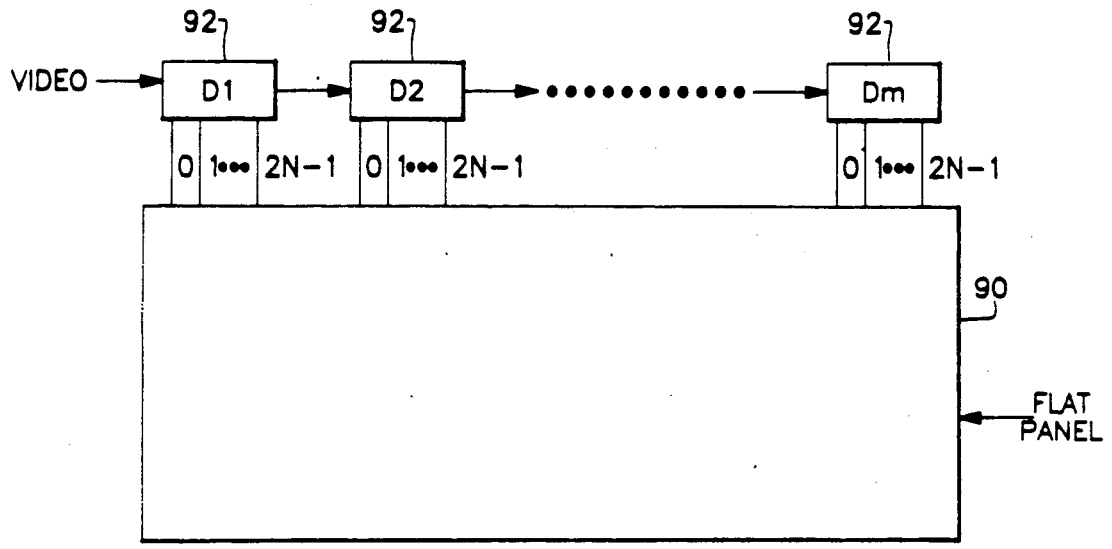
FIG. 7 shows a single-edge driver configuration for a flat panel.

Another approach is to tailor a new type of column driver IC, different from the one described above, to more efficiently achieve interwoven columns, as shown in FIG. 6. This particular driver arrangement can circumvent certain mechanical difficulties, which have become evident while implementing prototypes of methods described above. Only a single edge of flat panel 90 is needed, as revealed in FIG. 7, instead of two. This results in more flexibility. Wiring is simpler and the overall display module can be made smaller. Placing drivers 92 within panel 90, for an extremely compact and desirable method of assembly, is also feasible. In summary, since all the interweaving is accomplished within each driver IC, display module designs can be more flexible. The designs can be made to be more efficient and easier to implement.

Figure 8:
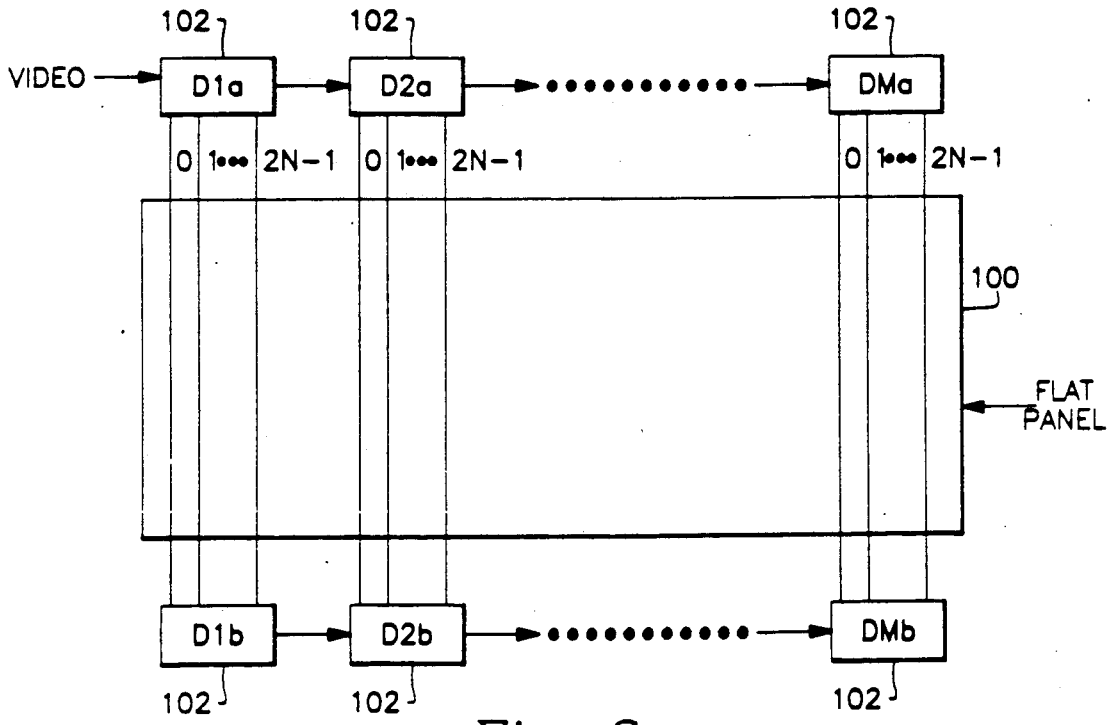
FIG. 8 shows a redundant driver configuration for a flat panel.

For a large panel 100, perhaps ten by ten inches in size, for example, as in FIG. 8, long bus lines are expected to induce performance non-uniformities, especially in terms of gray scale. To minimize long bus line impedances, resultant losses and other effects, redundant drives 102 are used. Incorporating redundant drives 102 with anti-flicker capability, impossible with prior art drivers, is possible with the present drivers. FIG. 8 is a diagram of a redundant drive for large panels to avoid yield problems or gray scale non-uniformities.

FIG. 6 shows a block diagram of column driver 30 tailored to eliminate flicker. Column driver 30 interweaves the columns. Functional blocks 34, 36, 38 and 40 are standard. The output stage, i.e., the driver amplifier section, is not standard. The output stage is implemented in two separately controllable segments, i.e., the even driver segment 32 and the odd driver segment 33.

Both driver segments 32 and 33 can be connected to either of source voltages 42 and 44 via supply rails 46 and 47 and switches 50 and 51. Source voltages 42 and 44 are typically of the same magnitude with respect to $V_{off}$ on rails 48 and 49 but of opposite polarity to each other. Switches 50 and 51 control which one of the two voltages 42 and 44 is directed to the supply rails 46 and 47, respectively. Switches 50 and 51 are controlled by the frame module 40 which is driven by frame signal 54. Frame signal 54 is typically driven by some form of the traditional vertical sync signal issued from the video source. Frame signal 54 is binary and oscillates with a period twice as long as that of the vertical sync. So after every vertical sync, switches 50 and 51 change position and select the polarity opposite of that of the previous cycle. Thus, drivers 32 and 33 provide alternating drive voltages to the panel to activate pixels. Alternating the polarity avoids electrolytic action inside the panel, which can be damaging.

A sense signal 52 is optional and may be used to command switches 50 and 51 to select the same polarity rather than the opposite polarity. Signal 52 is useful for using the driver in a traditional manner or in an anti-flicker mode in which two edges of the panel can be used to provide polarity interleaving (as illustrated in FIG. 5).

Supply rails 48 and 49 in FIG. 6 provide the voltage needed to deactivate the liquid crystal material and provide a reference DC level about which the polarities alternate. This voltage typically is the same as that applied to the substrate or common plane of LC panels. For the purpose of discussion here, such voltage is assumed to be at ground potential (i.e., 0 VDC).

Together, rails 46, 47, 48 and 49 supply binary levels of voltage to drivers 32 and 33. These binary levels can be used to provide binary or analog images. An analog optical output can be obtained, while using binary signal levels by time-modulating the length of time that switches 56 are "on", i.e., selecting activation rails 46 and 47 or by time-modulating the length of the time that active elements within the panel are allowed to be "on" and driven by this column driver.

Each pixel in the panel acts essentially as a capacitor driven by a current source. The longer the current source is allowed to charge a capacitor, the more voltage accumulates across it. Since the optical output is proportional to voltage, a continuous range of gray scales can be made available. The current source is allowed to charge the pixel capacitance under control of one of the column drivers 32 and 33 and the drive signals on the rows of the panel. This general category of control using fixed levels but varying "on" time to achieve a continuous range of control is often designated as pulse-width modulation.

Figure 9:
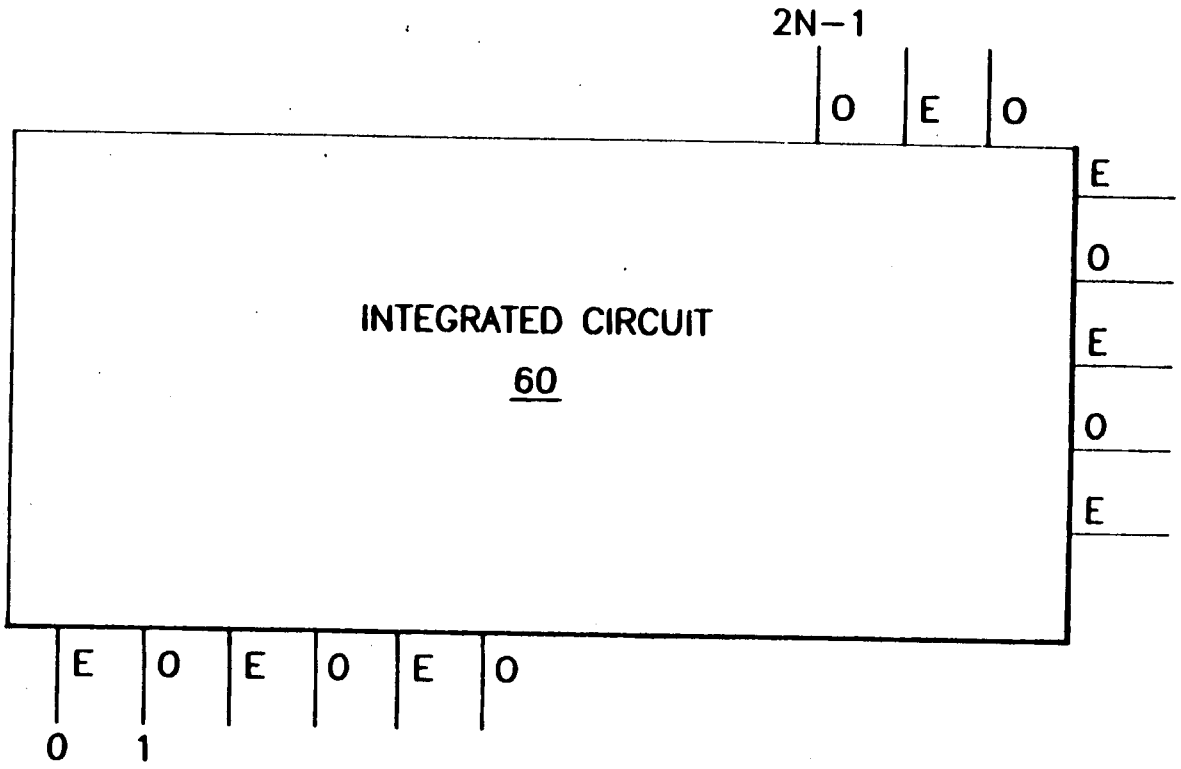
FIG. 9 reveals an interwoven segment outputs arrangement for an integrated circuit.

Segments 32 and 33 are physically arranged so that their outputs are interwoven at the pins of integrated circuit 60 of FIG. 9. Even and odd outputs alternate around the periphery of package 60. The number of outputs should be even in order to enable the convenient cascading of one driver with subsequent or prior drivers.

Figure 10:
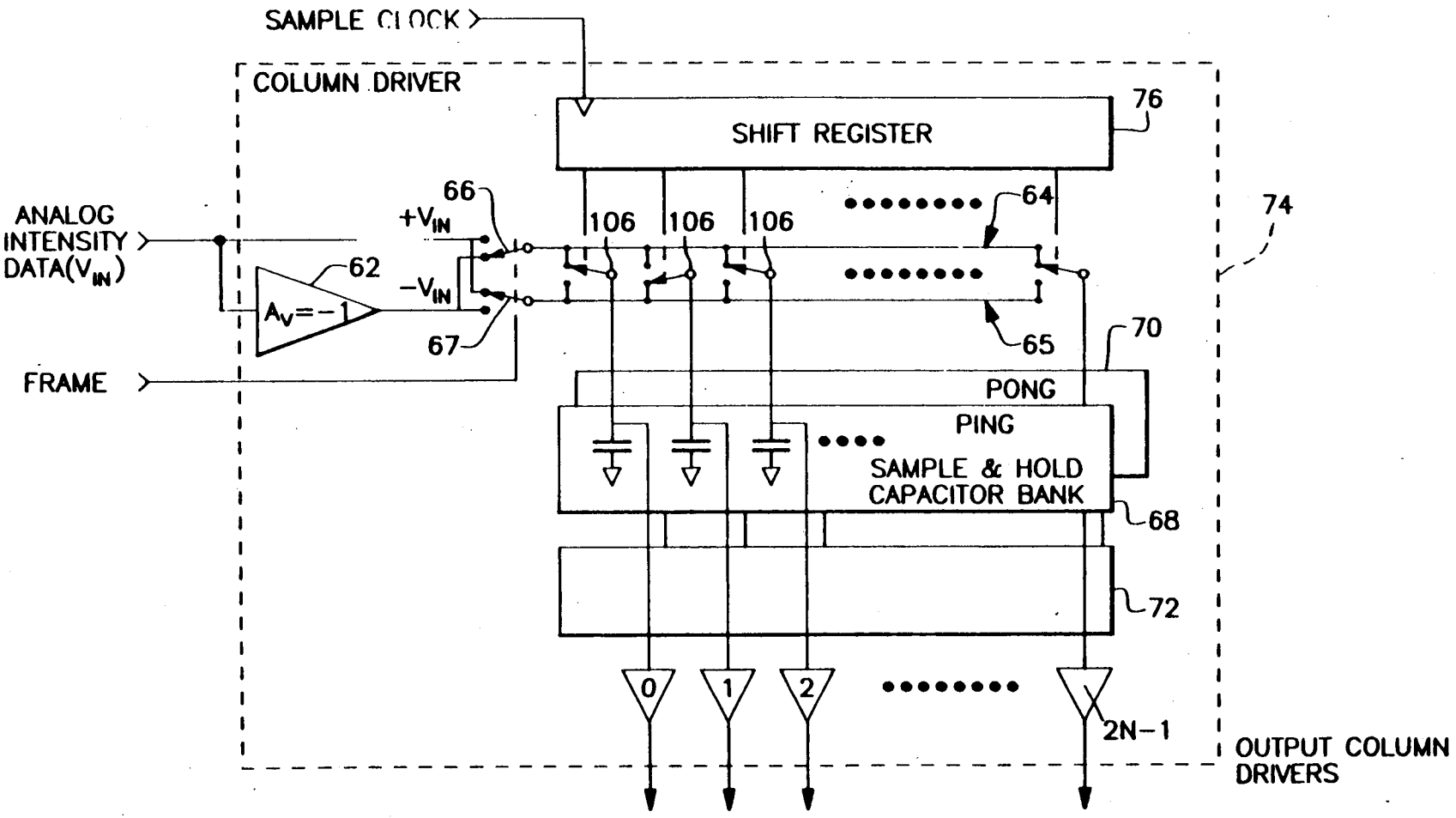
FIG. 10 is a diagram of an analog column driver having a ping-pong capacitor bank.

FIG. 10 shows an analog column driver 74 having similar anti-flicker functionality as that shown in FIG.

6, but for analog voltage levels. Inverting amplifier 62 is used to provide a polarity-reversed image of the incoming video signal. Switches 106 going to the analog drivers are once again such that odd and even outputs are interwoven to deliver opposite polarities. The polarity of $V_{in}$ going to each of sampling rails 64 and 65 is controlled by sampling switches 66 and 67. The even drivers are connected to rail 64 while the odd drivers are connected to rail 65. The polarity of the analog video present on the even rail 64, is the opposite of that on the odd rail 65 (unless once again a sense signal is applied to make the two rail switches 66 and 67 connect the same polarity). This approach results in column interweave for eliminating flicker but with a continuous range of analog voltage levels out. The same sort of rail switching is used as in the binary level case shown in FIG. 6. Rail switches 66 and 67 are controlled by the frame signal. Shift register 76, with a clock input, provides timing for sampling the input analog voltage.

Two banks 68 and 70 of capacitors (or a equivalent analog storage means) permit columns to be driven from one bank while video signals arrive and are stored in the other bank. The capacitors of banks 68 and 70 store samples of the voltages having polarities that are a function of the odd/even column count. Banks 68 and 70 operate in a ping-pong fashion, always storing an incoming line of video while writing to the flat panel with a previous line of video. Therefore, selector 72 must precede each driver output buffer. Selector 72 is a switch that chooses which capacitor bank is to be connected to the drivers.

The simplified schematic of the ping-pong or double sample-and-hold capacitor bank (68, 70) in FIG. 10 is well known and understood in the art. The sample/hold function is facilitated by sampling/multiplexing switches 106 connected to a bank of capacitors followed by buffer amplifiers. The switches 106 achieve the sampling/multiplexing function. Each sample-and-hold capacitor utilizes sampling switch 106 whose moment of closure is caused by the timing mechanism, i.e., shift register 76. Which individual capacitor of a bank samples the video is determined by the shift register. Which bank of capacitors is selected is controlled by the frame signal.

Figure 11:
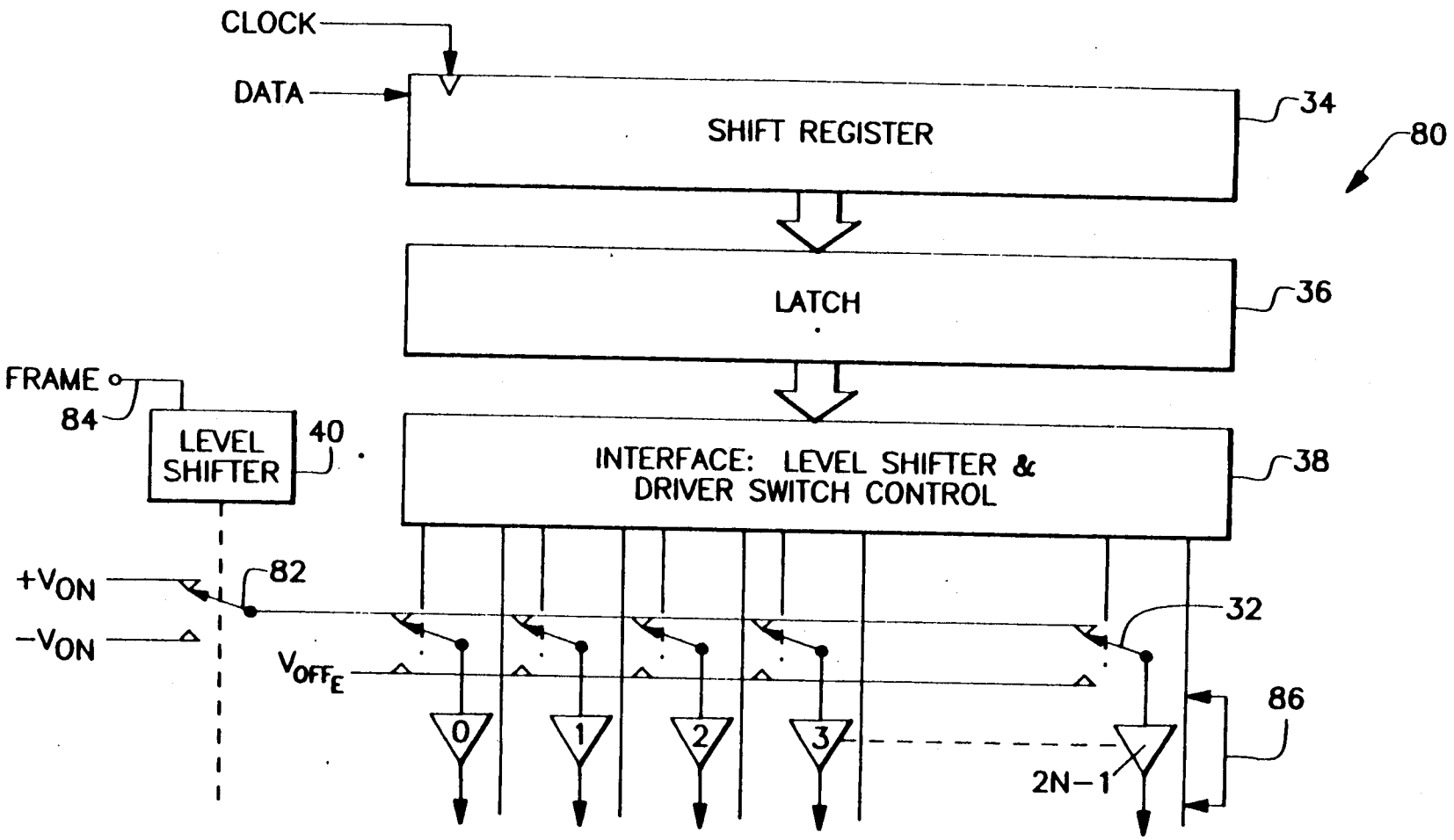
FIG. 11 is a block diagram of a driver having a rail select switch.

Another embodiment is illustrated by FIG. 11 which shows the block diagram of column driver 80 which includes anti-flicker functionality. FIG. 11 is similar to FIG. 6 except for the implementation of the rail select switch 82.

Rail select switch 82 routes either +V or −V to the drivers as determined by frame signal 84. Using standard transistor technology, switch 82 can be made much faster than those currently used in the art. In the prior art, the rail switch was not optimized to deliver speed needed to provide anti-flicker capability. The fact that flicker could be reduced by improved peripheral drive circuitry was not recognized in the prior art. But, using faster transistors like those in the driver stage 86, rail switch 82 can be implemented to change polarities in just a few microseconds. Thus, the polarity coming from driver stage 86 can be switched at the end of every row.

Driver 80 can be used to eliminate flicker using the row interweave technique of FIGS. 3*a* and 3*b*. Frame signal 84 must be altered to switch after every row instead of after every vertical trace, which is accomplished by connecting the frame circuit to a signal derived from horizontal sync instead of vertical sync. To ensure that each and every pixel is addressed with both +V and −V, in alternation, either an odd number of horizontal sync pulses per vertical interval must be guaranteed, or a simple horizontal/vertical sync circuit can be used to change the starting polarity after each interval. Nothing prevents the user from connecting the frame circuit to the traditional frame signal driven by vertical sync, which, if desired, would place this driver into a mode of the prior art.

Embodiment 80, when compared to the embodiment 74 above, does consume slightly more time at the end of each row. However, this additional time element is negligible for many applications, especially those at which line frequencies are low, as in the case of the standard RS-170 television format. About one part in sixty for a polarity change is all the time that is required for each row, which is a ratio most systems can easily tolerate with no impact on performance.

In television, typically all the even rows are scanned within one 16.66 millisecond (msec.) period followed by all the odd rows in the subsequent 16.66 msec. scanning period. Together these two periods, called fields, comprise a frame. The frame portrays the whole picture. So every 33.3 msec., a new frame is completed. Interweaving of the polarities can be accomplished in this format by using any of the methods outlined above. Just as easily, higher bandwidth formats, in which entire frames are presented within a single 16.66 msec. period, can be accommodated.

The ideas and means disclosed here are not limited to particular scan frequencies or patterns for interweaving the optical/polarity changes. They have been extended to include a wide range of scanning formats, traditional and non-traditional.

We claim:

1. A flicker-free liquid crystal display (LCD) system comprising:

a first plurality of lines of LCD pixels;

a second plurality of lines of LCD pixels, wherein said first and second pluralities of lines are interlaced in an alternating fashion to compose a display, such that each line of said first plurality of lines, is adjacent to at least one line of said second plurality of lines;

a first set of drivers connected to said first plurality of lines;

a second set of drivers connected to said second plurality of lines;

switching means, connected to said first and second sets of drivers, for providing a first voltage to said first set of drivers and a second voltage to said second set of drivers, wherein the first and second voltages have opposite polarities, with respect to each other, and the polarities are interchanged by said switching means at each frame change of display data;

interface means, connected to said first and second sets of drivers, for controlling said first and second sets of drivers;

a latching device connected to said interface means;

a shift register connected to said latching device; and wherein:

the display data and timing signals enter said shift register;

said shift register passes on a portion of display data to said latching device for retention for a certain period of time; and said interface means receives display data from said shift register via said latching device and provides signals to said first and second sets of drivers.

2. Display of claim 1 wherein the display data are in the form of pulses of various widths which ultimately excite respective pixels to various levels of shades relative to the widths of the pulses.

3. Display of claim 1 wherein said first and second sets of drivers are within said display and any inputs to said drivers enter only a single edge of said display.

4. Display of claim 1 wherein:

said first plurality of lines is the odd-numbered lines counted from a first edge of the display; and said second plurality of lines is the even-numbered lines counted from the first edge of the display.

5. Display of claim 4 wherein the lines are columns.

6. Display of claim 4 wherein the lines are rows.

7. A flicker-free liquid crystal display (LCD) system comprising:

a first plurality of lines of LCD pixels;

a second plurality of lines of LCD pixels, wherein said first and second pluralities of lines are interlaced in an alternating fashion to compose the display, such that each line of said first plurality of lines, is adjacent to at least one line of said second plurality of lines;

a first set of drivers connected to said first plurality of lines;

a second set of drivers connected to said second plurality of lines;

a first ping-pong sample-and-hold capacitor bank connected to said first and second sets of drivers;

a second ping-pong sample-and-hold capacitor bank connected to said first and second sets of drivers;

a shift register, connected to said first and second set of drivers and to said first and second ping-pong sample-and-hold capacitor banks, for receiving clock signals and display data, and for controlling said first and second sets of drivers; and switching means, connected to said first and second sets of drivers, for providing a first variable voltage to said first set of drivers and a second variable voltage to said second set of drivers, wherein the first and second variable voltages have opposite polarities, with respect to each other, and the polarities are interchanged by said switching means in response to a frame signal, and for receiving the variable first and second voltages wherein the first and second voltages have variations that represent intensity data for the pixels.

* * * * *

US005041823C1

(12) EX PARTE REEXAMINATION CERTIFICATE (7766th)

United States Patent

Johnson et al.

(10) Number: US 5,041,823 C1

(45) Certificate Issued: Sep. 28, 2010

(54) FLICKER-FREE LIQUID CRYSTAL DISPLAY DRIVER SYSTEM

(75) Inventors: Michael J. Johnson, Phoenix, AZ (US); Ronald C. Robinder, Albuquerque, NM (US)

(73) Assignee: Honeywell Inc., Minneapolis, MN (US)

Reexamination Request:
No. 90/010,249, Aug. 19, 2008

Reexamination Certificate for:

| | |
|---|---|
| Patent No.: | **5,041,823** |
| Issued: | **Aug. 20, 1991** |
| Appl. No.: | **07/291,726** |
| Filed: | **Dec. 29, 1988** |

(51) Int. Cl.
*G09G 3/36* (2006.01)

(52) U.S. Cl. ..... 345/94

(58) Field of Classification Search ..... 345/94
See application file for complete search history.

(56) References Cited

U.S. PATENT DOCUMENTS

| | | | |
|---|---|---|---|
| 3,902,169 | A | 8/1975 | Washizuka |
| 4,091,377 | A | 5/1978 | Shimoi |
| 4,100,540 | A | 7/1978 | Fujita et al. |
| 4,168,796 | A | 9/1979 | Fulks et al. |
| 4,292,625 | A | 9/1981 | Schoeff |
| 4,368,523 | A | 1/1983 | Kawate |
| 4,380,008 | A | 4/1983 | Kawakami et al. |
| 4,384,320 | A | 5/1983 | Incledon et al. |
| 4,413,256 | A | 11/1983 | Yasuda et al. |
| 4,427,978 | A | 1/1984 | Williams |
| 4,560,982 | A | 12/1985 | Sonehara et al. |
| 4,635,127 | A | 1/1987 | Togashi |
| 4,643,526 | A | 2/1987 | Watanabe et al. |
| 4,653,862 | A | 3/1987 | Morozumi |
| 4,691,200 | A | 9/1987 | Stephany |
| 4,694,349 | A | 9/1987 | Takeda et al. |
| 4,702,560 | A | 10/1987 | Endo et al. |
| 4,715,688 | A | 12/1987 | Harada et al. |
| 4,716,403 | A | 12/1987 | Morozumi |
| 4,742,346 | A | 5/1988 | Gillette et al. |
| 4,789,899 | A | 12/1988 | Takahashi et al. |
| 4,808,991 | A | 2/1989 | Tachiuchi et al. |
| 4,823,126 | A | 4/1989 | Nagata et al. |
| 4,842,371 | A | 6/1989 | Yasuda et al. |
| 5,058,994 | A | 10/1991 | Mihara et al. |
| 5,093,655 | A | 3/1992 | Tanioka et al. |
| 5,182,549 | A | 1/1993 | Taniguchi et al. |

FOREIGN PATENT DOCUMENTS

| | | | |
|---|---|---|---|
| EP | 0 031 143 | A2 | 7/1981 |
| EP | 0 242 468 | A1 | 10/1987 |
| JP | 63-068821 | A | 3/1963 |
| JP | 55-137587 | A | 10/1980 |
| JP | 55-137588 | A | 10/1980 |

(Continued)

OTHER PUBLICATIONS

Heftman, "Display Driver ICs Light the Way for Flat–Panel Displays", Electronic Design, Mar. 12, 1986, pp. 29–34.

(Continued)

*Primary Examiner*—Fred Ferris

(57) ABSTRACT

A flicker-free liquid crystal display driver system driving two groups of pixels with alternating polarities. The spatial differentiation of the two groups, which may be accomplished in terms of even and odd rows or columns, is small so as to diminish detection by a human eye of the flicker in the display. The driver system incorporates a level shifter, switches, drivers, a driver switch control, a holding means and a storage means. Input signals to the system include that of intensity data, a clock and frames. The configuration of the driver system may be of a single-edge or redundant drive. The system may be digital or analog.

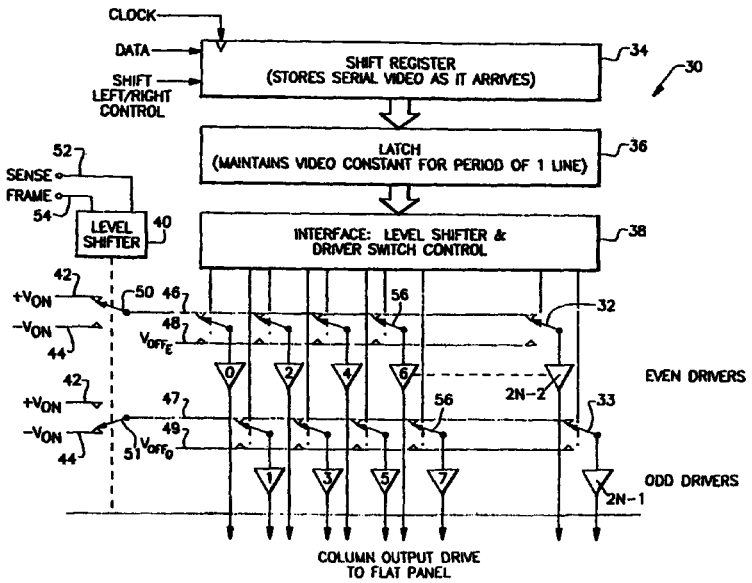

FOREIGN PATENT DOCUMENTS

| | | | |
|---|---|---|---|
| JP | 59-153388 | A | 9/1984 |
| JP | 59-159178 | A | 9/1984 |
| JP | 60-127387 | A | 7/1985 |
| JP | 60-151615 | A | 8/1985 |
| JP | 60-156095 | A | 8/1985 |
| JP | 60-258590 | A | 12/1985 |
| JP | 61-275821 | A | 12/1986 |
| JP | S61-275822 | | 12/1986 |
| JP | S61-275823 | | 12/1986 |
| JP | 61-275824 | A | 12/1986 |
| JP | S61-275825 | | 12/1986 |
| JP | 61-294416 | A | 12/1986 |
| JP | 62-017731 | A | 1/1987 |
| JP | 62-071932 | A | 4/1987 |
| JP | 62-113129 | A | 5/1987 |
| JP | 62-116924 | A | 5/1987 |
| JP | 62-137981 | A | 6/1987 |
| JP | 62-175074 | A | 7/1987 |
| JP | 62-195628 | A | 8/1987 |
| JP | 62-198279 | A | 9/1987 |
| JP | 62-209515 | A | 9/1987 |
| JP | 62-209584 | A | 9/1987 |
| JP | 62-230172 | A | 10/1987 |
| JP | 62-241481 | A | 10/1987 |
| JP | 62-272777 | A | 11/1987 |
| JP | S62-272792 | | 11/1987 |
| JP | 62-272795 | A | 11/1987 |

OTHER PUBLICATIONS

"New Driving Method for Liquid Crystal Display", IBM Technical Disclosure Bulletin, May 1988, vol. 30, No. 12.

Katagishi, et al., "A New Driving Technique for Flicker–Free Full–Resolution LCD–TV", SID 86 Digest, 1986, pp. 285–288.

Erlewein, J. et al., "*Chip on Glass" Technology for Large Scale Automotive Displays,* SAE Technical Paper Series, 1984, pp. 31–35.

Faughnan, B. W. et al., *Polycrystalline–Silicon LCDs With High–Speed Integrated Scanners,* Proceedings of the SID, vol. 19/4, 1988, pp. 279–282.

Stewart, R. G. et al., *Polycrystalline Silicon Liquid LCDs With High–Speed Integrated Scanners,* SID 88 Digest, vol. XIX, 1988, pp. 404–405.

Powell, M. J. et al., *A 6–in. Full–Color Liquid–Crystal Television Using an Active Matrix of Amorphous–Silicon TFTs,* Proceedings of the SID, vol. 29/3, 1988, pp. 227–232.

*Defect–Tolerant Active Matrix Circuit With Duplicated Data Input Route for Large Liquid Crystal Display,* Electronics Letters, vol. 21, No. 22, Oct. 1985, pp. 1051–1052.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-6 are cancelled.

Claim 7 was not reexamined.

* * * * *